US010041154B2

(12) United States Patent
Hirayama et al.

(10) Patent No.: US 10,041,154 B2
(45) Date of Patent: Aug. 7, 2018

(54) ALUMINUM ALLOY SHEET AND METHOD FOR MANUFACTURING SAME

(75) Inventors: Tomoyuki Hirayama, Shizuoka (JP); Pizhi Zhao, Shizuoka (JP); Takeshi Handa, Shizuoka (JP); Toshiya Anami, Shizuoka (JP); Yusuke Nagaishi, Sagamihara (JP); Koji Itakura, Fujisawa (JP); Hirokazu Miyagawa, Fujisawa (JP); Tsutomu Hattori, Atsugi (JP); Shigenori Yoshizawa, Zama (JP); Akio Yoshizawa, Tochigi (JP)

(73) Assignees: NIPPON LIGHT METAL COMPANY, LTD., Tokyo (JP); NISSAN MOTOR CO., LTD., Yokohama-shi (JP)

( * ) Notice: Subject to any disclaimer, the term of this patent is extended or adjusted under 35 U.S.C. 154(b) by 548 days.

(21) Appl. No.: 14/234,770

(22) PCT Filed: Jul. 10, 2012

(86) PCT No.: PCT/JP2012/067587
§ 371 (c)(1),
(2), (4) Date: Jan. 24, 2014

(87) PCT Pub. No.: WO2013/015110
PCT Pub. Date: Jan. 31, 2013

(65) Prior Publication Data

US 2014/0166162 A1 Jun. 19, 2014

(30) Foreign Application Priority Data

Jul. 25, 2011 (JP) ..... 2011-162284

(51) Int. Cl.
*C22C 21/06* (2006.01)
*C22F 1/047* (2006.01)
(Continued)

(52) U.S. Cl.
CPC ..... *C22C 21/08* (2013.01); *B22D 11/003* (2013.01); *C22C 21/06* (2013.01); *C22F 1/00* (2013.01);
(Continued)

(58) Field of Classification Search
CPC ..... C22F 1/047; C22C 21/06
See application file for complete search history.

(56) References Cited

U.S. PATENT DOCUMENTS 5,540,791 A 7/1996 Matsuo et al.
6,369,347 B1 4/2002 Zhao et al.
(Continued)

FOREIGN PATENT DOCUMENTS

EP 0 690 142 A1 1/1996
JP 5-5149 A 1/1993
(Continued)

OTHER PUBLICATIONS

Azari, H.N. et al, Metallurgical and Materials Transactions A. 'Effect of Thermomechanical Treatment on the Evolution of Rolling and Recrystallization Textures in Twin-Belt Cast AA5754 Aluminum Alloy', Jun. 2004, p. 1839-1851.
(Continued)

*Primary Examiner* — Lois Zheng
(74) *Attorney, Agent, or Firm* — Foley & Lardner LLP

(57) ABSTRACT

An aluminum alloy sheet includes an aluminum alloy substrate having a composition containing, by mass percentage, 3.0 to 4.0% of magnesium, 0.2 to 0.4% of manganese, 0.1 to 0.5% of iron, not less than 0.03% but less than 0.10% of copper, and less than 0.20% of silicon, with the remainder being aluminum and unavoidable impurities. A peak concentration of a copper concentration distribution in a thickness direction in a region at a depth of 15 nm to 200 nm from the surface of the aluminum alloy substrate is equal to or
(Continued)

more than 0.15%, and the aluminum alloy substrate has a recrystallized structure with an average grain size of 15 μm or less.

2 Claims, 3 Drawing Sheets

(51) Int. Cl.

| | |
|---|---|
| ***C22C 21/08*** | (2006.01) |
| ***C22F 1/00*** | (2006.01) |
| ***B22D 11/00*** | (2006.01) |
| *B21B 3/00* | (2006.01) |

(52) U.S. Cl.
CPC ..... *C22F 1/047* (2013.01); *B21B 2003/001* (2013.01)

(56) References Cited

U.S. PATENT DOCUMENTS

| | | | | |
|---|---|---|---|---|
| 6,544,358 | B1 | 4/2003 | Carr et al. | |
| 8,016,958 | B2 | 9/2011 | Zhao et al. | |
| 8,425,698 | B2 * | 4/2013 | Zhao | B22D 11/003 148/551 |
| 2007/0217943 | A1 | 9/2007 | Zhao et al. | |
| 2008/0295922 | A1 * | 12/2008 | Zhao | C22C 21/06 148/439 |
| 2009/0007994 | A1 | 1/2009 | Zhao et al. | |
| 2009/0269613 | A1 | 10/2009 | Zhao et al. | |
| 2010/0307645 | A1 * | 12/2010 | Zhao | C22C 21/08 148/552 |

FOREIGN PATENT DOCUMENTS

| | | | |
|---|---|---|---|
| JP | 6-256881 | A | 9/1994 |
| JP | 7-26342 | A | 1/1995 |
| JP | 7-145488 | A | 6/1995 |
| JP | 7-197177 | A | 8/1995 |
| JP | 7-278716 | A | 10/1995 |
| JP | 7-310136 | A | 11/1995 |
| JP | 8-99256 | A | 4/1996 |
| JP | 8165538 | A | 6/1996 |
| JP | 8-277434 | A | 10/1996 |
| JP | 9-195019 | A | 7/1997 |
| JP | 9-263868 | A | 10/1997 |
| JP | 10-8177 | A | 1/1998 |
| JP | 11-012676 | A | 1/1999 |
| JP | 11-80873 | A | 3/1999 |
| JP | 2001-32031 | A | 2/2001 |
| JP | 2001-335875 | A | 12/2001 |
| JP | 2001-348670 | A | 12/2001 |
| JP | 2004-76155 | A | 3/2004 |
| JP | 2005-307300 | A | 11/2005 |
| JP | 2006-219763 | A | 8/2006 |
| JP | 2007-186741 | A | 7/2007 |
| JP | 2008-024964 | | 2/2008 |
| JP | 2008-508421 | A | 3/2008 |
| JP | 2008-163357 | A | 7/2008 |
| JP | 2008-223054 | A | 9/2008 |
| WO | WO-2007/080689 | A1 | 7/2007 |

OTHER PUBLICATIONS

International Search Report for PCT/JP2013/050327 dated Mar. 26, 2013, 5 pages.
Takahashi et al., English machine translation of JP 2008-223054, Sep. 2008, pp. 9 pages.
Mexican Office Action and English translation, Jun. 12, 2017, 7 pages.

* cited by examiner (a)

No. 1

(b)

No. 4

ALUMINUM ALLOY SHEET AND METHOD FOR MANUFACTURING SAME

TECHNICAL FIELD

The present invention relates to an aluminum alloy sheet and a method for manufacturing the same, and more particularly to an aluminum alloy sheet excellent in chemical conversion treatability and formability and a method for manufacturing the same.

BACKGROUND ART

Generally, a steel sheet or an aluminum alloy sheet for a vehicle body of an automobile is formed into a predetermined shape by press forming or the like and thereafter undergoes an assembly operation and is then subjected to chemical conversion treatment. Incidentally, the chemical conversion treatment refers to treatment for depositing zinc phosphate on the surface of the steel sheet or the aluminum alloy sheet before coating. The chemical conversion treatment also serves as pretreatment for the coating. It is therefore necessary to uniformly deposit a sufficient amount of zinc phosphate on the surface of the aluminum alloy sheet in order to improve material corrosion resistance or coating film sharpness after the coating.

Then, in a case where zinc phosphate is not uniformly deposited on the surface of the aluminum alloy sheet when the aluminum alloy sheet is subjected to zinc phosphate treatment by the chemical conversion treatment, there is the possibility of a reduction in the corrosion resistance such as filiform corrosion resistance or coating film blistering resistance and a reduction in the coating film sharpness.

Incidentally, the chemical conversion treatment involves providing a series of surface treatments such as degreasing, rinsing, surface conditioning, zinc phosphate treatment, and rinsing, and such a series of process steps is called chemical conversion treatment operation. Then, under the zinc phosphate treatment, the surface of the aluminum alloy sheet undergoes an anodic reaction and a cathodic reaction which occur simultaneously in a zinc phosphate solution, as given below.

Anodic reaction (1): $Al \rightarrow Al^{3+} + 3e^-$ (oxidation reaction, electron donating reaction) (1)

Cathodic reaction: $2H^+ + 2e^- \rightarrow H_2$ (reduction reaction, or electron accepting reaction) (2)

When the cathodic reaction as above proceeds, hydrogen ions in the zinc phosphate solution can naturally be consumed to thus increase the pH of the solution; however, the water dissociation constant, $[H^+][OH^-]=10^{-14}$, remains substantially constant. In other words, as soon as a reaction as given below proceeds through what is called the law of chemical equilibrium thereby to feed protons ($H^+$) into the zinc phosphate solution, zinc phosphate is deposited on the surface of the aluminum alloy sheet.

$$3Zn(H_2PO_4)_2 \rightarrow Zn_3(PO_4)_2\downarrow + 4H_3PO_4 \quad (3)$$

Here, uniform deposition of zinc phosphate on the surface of the aluminum alloy sheet requires that the anodic reaction (1) and the cathodic reaction (2) occur uniformly. Examples of a typical method for uniformly depositing zinc phosphate by accelerating simultaneously the anodic reaction (1) and the cathodic reaction (2) include adjustment of the composition of alloy. Then, it is known that 5000 series aluminum alloys, in particular, are affected greatly by the influence of the amount of copper and hence a lower content of copper in the alloys leads to lower zinc phosphate treatability. (Refer to Patent Literature 1, for example.) Also, Patent Literature 1 states that an Al—Mg based alloy having a copper content of 0.10% or less is prone to be insufficient in the amount of zinc phosphate coating film formed.

Also, the methods for uniformly depositing zinc phosphate include an approach of enhancing pretreatment (e.g. degreasing, rinsing, and surface conditioning) for zinc phosphate treatment. Specifically, it is known that phosphate treatability is improved by treating an aluminum material made of an Al—Mg—Si based alloy with an acid containing fluorine ions. (Refer to Patent Literature 2, for example.) This aluminum material is suitable for use as a body material for automobiles and is excellent in corrosion resistance.

Further, the methods for uniformly depositing zinc phosphate include an approach of reexamining a manufacturing process for an aluminum alloy sheet thereby to improve beforehand a surface condition for purposes of chemical conversion treatment. Specifically, in a manufacturing method of Patent Literature 3, a sheet material made of an Al—Mg based alloy, an Al—Mg—Si based alloy or an Al—Cu—Mg based alloy is, first, continuously heat treated through a heating zone and a cooling zone. Subsequently to the heat treatment, the sheet material is then subjected to a process for removing a surface oxide film by an alkaline solution or an acid solution, and, thereafter, is continuously heated to a temperature of 40° C. to 120° C. and is immediately wound up in a coil. Thereby, an aluminum alloy sheet excellent in formability and zinc phosphate treatability and also excellent in baking finish hardenability for an alloy group having baking finish hardenability is obtained. Also, it is stated that the aluminum alloy sheet is suitably available for use as a structural member for transport equipment, such as an outer panel of an automobile, in particular.

Also, a method for uniformly depositing zinc phosphate by improving the alloy composition of a material in itself by adding an element for accelerating the above anodic reaction (1) or cathodic reaction (2) to an original slab of an aluminum alloy sheet is possible. Patent Literature 4 discloses an aluminum alloy containing, by weight percentage, 2 to 6% magnesium and 0.3 to 2.0% zinc, and having, as impurities, copper, the content of which is limited to less than 0.03%, iron, the content of which is limited to less than 0.4%, and silicon, the content of which is limited to less than 0.4%, and having the remainder being aluminum and unavoidable impurities, and having manganese (Mn), chromium (Cr), zirconium (Zr), vanadium (V), titanium (Ti) and boron (B) added as selective ingredients. There is a disclosure indicating that the aluminum alloy is excellent in formability and zinc phosphate treatability for a vehicle body panel of an automobile.

Further, Patent Literature 5 discloses an Al—Mg—Si alloy sheet containing not less than 0.05% but less than 0.3% by mass of zinc, in which the content of copper is limited to less than 0.05% by mass. Also, the surface of the Al—Mg—Si alloy sheet is provided with a zincate film of 0.1 to 1.5 $g/m^2$. The zincate treated Al—Mg—Si alloy sheet has the zincate film formed by single treatment and excellent in adhesive properties. Also, it is stated that excellent zinc phosphate treatability and corrosion resistance can be imparted to the alloy sheet and the alloy sheet is suitably available for use as an outer sheet of an automobile, in particular.

Until now, the inventor of the present invention has made various discussions on 5000 series aluminum alloy sheets for automobile manufactured from a slab continuously cast by a thin slab continuous casting machine. Then, Patent Literature 6 discloses an Al—Mg alloy sheet excellent in continuous resistance spot weldability. The Al—Mg alloy sheet contains, by weight, 2 to 6% magnesium, 0.15 to 1.0% iron, and 0.03 to 2.0% manganese. Also, the alloy sheet is characterized in that a surface layer of the alloy sheet on the side thereof to be pressed against an electrode in resistance spot welding contains 4000 or more intermetallic compounds having a grain size of 0.5 μm or more, per square millimeter.

Also, the inventor of the present invention has disclosed an Al—Mg alloy sheet having excellent bake softening resistance in Patent Literature 7. The Al—Mg alloy sheet contains 2 to 5% by mass of magnesium, more than 0.05% but not more than 1.5% by mass of iron, and 0.05 to 1.5% by mass of manganese, and the total content of iron (Fe) and manganese (Mn) exceeds 0.3% by mass. Also, the alloy sheet is characterized in that the content of iron in a solid solution is equal to or more than 50 ppm, in that intermetallic compounds with 1 to 6 μm of an equivalent circle diameter are present for 5000 or more per square millimeter, and further, in that an average sizes of recrystallized grains is 20 μm or less.

Further, the inventor of the present invention has provided an Al—Mg alloy sheet having excellent deep drawability and bake softening resistance as disclosed in Patent Literature 8. The Al—Mg alloy sheet contains, by mass, 1 to 5% magnesium, 0.1 to 1.0% iron, 0.005 to 0.1% titanium, 0.0005 to 0.01% boron, and unavoidable impurities, and the content of silicon in the unavoidable impurities is set to be less than 0.20%. Also, the alloy sheet is characterized in that the solid solution content of iron in a matrix is 50 ppm or more, in that the diameter of recrystallized grain is 12 μm or less, and in that a limited drawing ratio is 2.13 or more.

However, none of Patent Literatures 6 to 8 have made mention of chemical conversion treatability.

CITATION LIST

Patent Literature

Patent Literature 1: Japanese Unexamined Patent Application Publication No. H8-99256
Patent Literature 2: Japanese Unexamined Patent Application Publication No. H7-145488
Patent Literature 3: Japanese Unexamined Patent Application Publication No. H9-195019
Patent Literature 4: Japanese Unexamined Patent Application Publication No. H8-277434
Patent Literature 5: Japanese Unexamined Patent Application Publication No. 2001-348670
Patent Literature 6: Japanese Unexamined Patent Application Publication No. H11-80873
Patent Literature 7: Japanese Unexamined Patent Application Publication No. 2004-76155
Patent Literature 8: Japanese Unexamined Patent Application Publication No. 2008-223054

SUMMARY OF INVENTION

Technical Problem

However, further improvements in formability and chemical conversion treatability are required in a case where an aluminum alloy sheet is used for a vehicle body of an automobile.

The present invention has been made in view of the foregoing problems inherent in the conventional technologies. Therefore, an object of the present invention is to provide an aluminum alloy sheet excellent in formability and chemical conversion treatability and a method for manufacturing the same.

Solution to Problem

An aluminum alloy sheet according to a first aspect of the present invention includes an aluminum alloy substrate having a composition containing, by mass percentage, 3.0 to 4.0% of magnesium, 0.2 to 0.4% of manganese, 0.1 to 0.5% of iron, not less than 0.03% but less than 0.10% of copper, and less than 0.20% of silicon, with the remainder being aluminum and unavoidable impurities. Also, a peak concentration of a copper concentration distribution in a thickness direction in a region at a depth of 15 nm to 200 nm from a surface of the aluminum alloy substrate is equal to or more than 0.15%. Further, the aluminum alloy substrate has a recrystallized structure with an average grain size of 15 μm or less.

A method for manufacturing the aluminum alloy sheet according to a second aspect of the present invention includes the steps of continuously casting a molten aluminum alloy into a slab of 2 to 15 mm thick by using a thin slab continuous casting machine, the molten aluminum alloy having a composition containing, by mass percentage, 3.0 to 4.0% of magnesium, 0.2 to 0.4% of manganese, 0.1 to 0.5% of iron, not less than 0.03% but less than 0.10% of copper, and less than 0.20% of silicon, with the remainder being aluminum and unavoidable impurities; directly winding up the slab in a roll without subjecting the slab to hot rolling; subjecting the slab to cold rolling with a final cold reduction of 70 to 95%, after winding up the slab; and subjecting the slab to final annealing, after subjecting the slab to the cold rolling.

Advantageous Effects of Invention

A 5000 series aluminum alloy sheet of the present invention is manufactured from a slab continuously cast by a thin slab continuous casting machine. Also, in the aluminum alloy sheet, the alloy composition of material, particularly, the content of copper (Cu), is specified to thus enable accelerating the above cathodic reaction (2) and thereby uniformly depositing zinc phosphate. Further, the composition of magnesium (Mg) and other elements of the 5000 series aluminum alloy sheet is limited thereby to enable achieving the aluminum alloy sheet which is not prone to form a stretcher-strain mark (or an SS mark) caused by forming.

According to the aluminum alloy sheet according to the present invention, further, the peak concentration of the copper concentration distribution in the thickness direction in the region at a depth of 15 nm to 200 nm from the surface of the aluminum alloy sheet is equal to or more than 0.15% by mass. Thus, during zinc phosphate treatment, the cathodic reaction (2) is accelerated on the surface of the aluminum alloy sheet thereby to uniformly deposit zinc phosphate. Also, in the aluminum alloy sheet of the present invention, the alloy composition such as magnesium is limited, and thus, the aluminum alloy sheet has the recrystallized structure with an average grain size of 15 μm or less. Thus, it is possible to provide the aluminum alloy sheet which is not prone to form a stretcher-strain mark caused by forming and, further, is excellent in formability.

Also, in the method for manufacturing an aluminum alloy sheet according to the present invention, a slab of 2 mm to 15 mm thick is continuously cast by using a thin slab continuous casting machine. Then, the slab is directly wound up in a roll without undergoing hot rolling, and thereafter, the slab is subjected to cold rolling. In the cold rolling, the final cold reduction is 70 to 95%. Then, after undergoing the cold rolling, the thin slab is subjected to final annealing. Thus, even if the concentration of copper in the molten aluminum alloy is 0.03 to 0.12% by mass, the peak concentration of the copper concentration distribution in the thickness direction in the region at a depth of 15 to 200 nm from the surface of the aluminum alloy sheet is finally equal to or more than 0.15% by mass. Such a peak concentration of the copper concentration distribution can be considered to be possible with a casting method characteristic of thin slab casting, as described later.

Incidentally, copper segregation caused by casting occurs also in a surface layer portion of a slab semi-continuously cast by a direct chill casting machine (DC casting machine). In other words, a portion in which a solute element such as iron, silicon or copper is concentrated, as what is called a segregation layer, is present also in the surface layer portion of the slab. In the case of the semi-continuously cast slab, however, the slab is typically subjected to facing on both surfaces, before homogenization treatment, for purposes of removal of defects caused by sweating or the like on the surface, or what is called the segregation layer. The slab surface layer portion of about 5 to 40 mm in thickness is removed for each of the surfaces by the facing, although it may vary depending on the alloy, what purpose the slab is used for, or the shape of the slab.

Then, the semi-continuously cast slab which has undergone the facing is subjected to heat treatment or the like in a homogenization treatment process, a hot rolling process, and a final annealing process after cold rolling. Thus, an element such as copper is diffused into and concentrated in a boundary between an oxide film and the surface of the alloy sheet. In this concentration layer, therefore, the cathodic reaction (2) is accelerated on the surface of the alloy sheet during early stages of the reaction at the time of zinc phosphate treatment, thereby accelerating the reaction. However, when the reaction proceeds, aluminum on the surface is dissolved as $Al^{3+}$ ions in a solution to thus promote the corrosion on the surface of the alloy sheet. Thus, the effect of accelerating the cathodic reaction (2) by the copper concentrated layer disappears soon.

DESCRIPTION OF EMBODIMENTS

Figure 1:
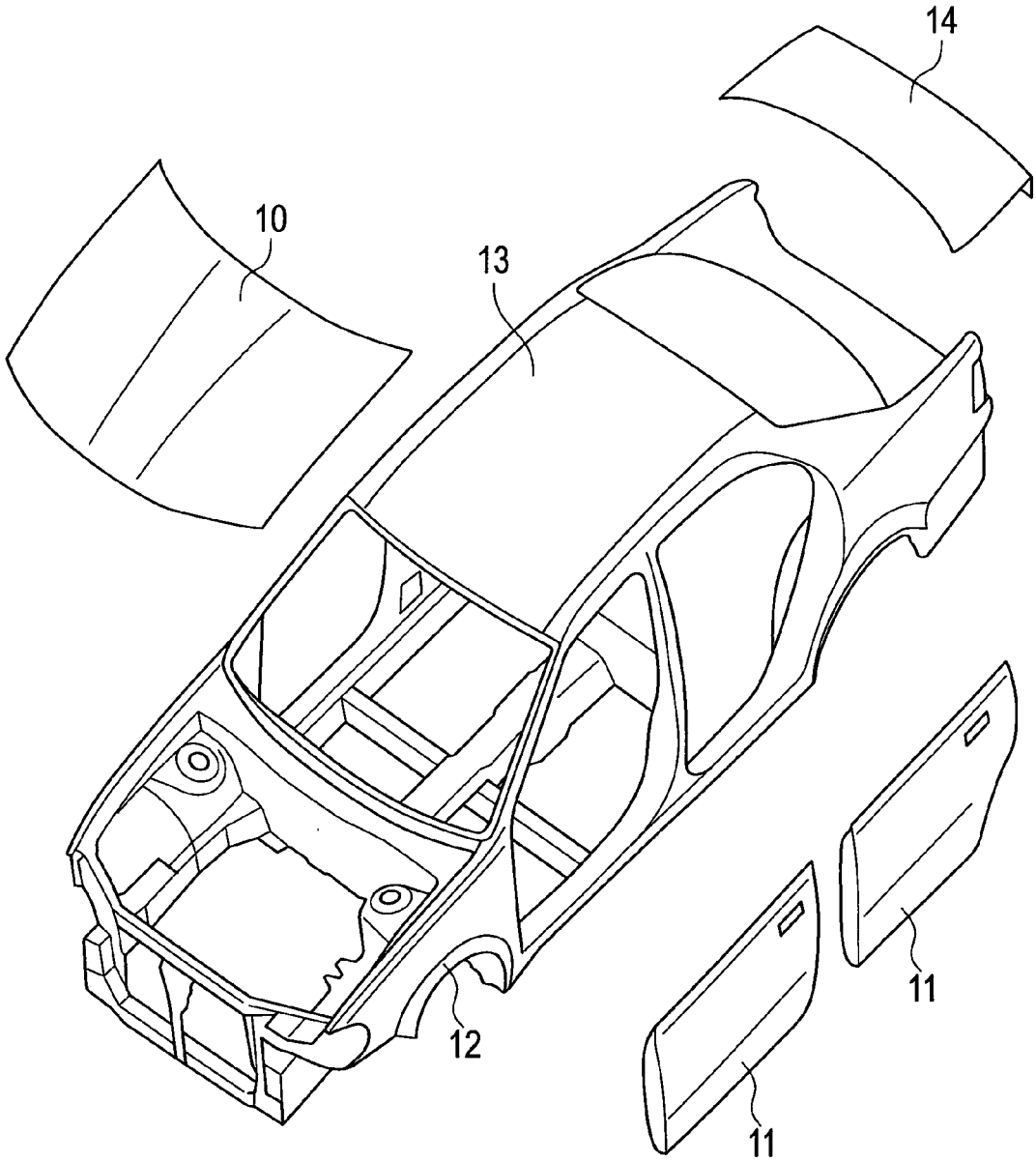
FIG. 1 is a schematic view illustrating, by way of example, a vehicle using an aluminum alloy sheet according to an embodiment of the present invention.

An embodiment of the present invention will be described below with reference to the drawings. In the following disclosure of the drawings, the same portions are indicated by the same reference numerals. It is to be noted that the drawings are schematic ones and relationships between thicknesses and plan dimensions are different from actual ones. Therefore, it is to be understood that specific thicknesses and dimensions are determined, taken in connection with the following description. Of course, it will also be understood that the drawings include portions in which they are different from each other in their relative dimensions or ratios.

A method for manufacturing an aluminum alloy sheet according to the present embodiment first prepares a molten aluminum alloy. The molten aluminum alloy has a composition containing, by mass percentage, 3.0 to 4.0% of magnesium (Mg), 0.2 to 0.4% of manganese (Mn), 0.1 to 0.5% of iron, not less than 0.03% but less than 0.10% of copper, and less than 0.2% of silicon (Si) as unavoidable impurities, with the remainder being aluminum (Al) and unavoidable impurities. Then, the molten aluminum alloy is continuously cast into a thin slab of 2 mm to 15 mm thick by using a thin slab continuous casting machine. Then, the thin slab is directly wound up in a roll without undergoing hot rolling, and thereafter, the thin slab is subjected to cold rolling. The cold rolling is such that a final cold reduction of the thin slab is 70 to 95%. After undergoing the cold rolling, the thin slab is subjected to final annealing. In the aluminum alloy sheet (or an aluminum alloy substrate) obtained in this manner, a peak concentration of a copper (Cu) concentration distribution in a thickness direction in a region at a depth of 15 nm to 200 nm from the surface of the aluminum alloy substrate is equal to or more than 0.15% by mass. Further, the aluminum alloy sheet (or the aluminum alloy substrate) has a recrystallized structure with an average grain size of 15 μm or less.

The thin slab continuous casting machine includes both a twin-belt casting machine and a twin-roll casting machine. The twin-belt casting machine includes a pair of rotating belt portions having an endless belt and vertically facing each other, a cavity formed between the pair of rotating belt portions, and a cooling device provided within the rotating belt portions. Then, molten metal is fed into the cavity through a nozzle made of a refractory material a semi-continuously cast into a thin slab.

The twin-roll casting machine includes a pair of rotating roll portions having an endless roll and vertically facing each other, a cavity formed between the pair of rotating roll portions, and a cooling device provided within the rotating roll portions. Then, molten metal is fed into the cavity through a nozzle made of a refractory material and is continuously cast into a thin slab.

Then, a meniscus is formed on the surface of the molten aluminum alloy in a short time until the molten aluminum alloy moves from a nozzle tip to the belt when the molten aluminum alloy is fed into the cavity through the nozzle in the thin slab continuous casting machine. Then, the surface of the molten aluminum alloy in the meniscus area is in contact with an atmosphere (or air) in the cavity. It is possible that meanwhile the surface of the molten aluminum alloy in the meniscus area undergoes oxidation and slow cooling, a very thin oxide film is formed on the surface of the molten aluminum alloy, and further, a very thin α-Al phase (or a solid phase) is precipitated on the inner side of the oxide film. It is possible that, when this very thin α-Al shell is formed, the α-Al phase grows from the surface, and a solute element such as copper (Cu) in the molten aluminum alloy is discharged to the inner side of the slab, and a segregation layer in a liquid phase is formed. The solute element such as copper (Cu) concentrated in the segregation layer in the liquid phase is diffused toward the liquid phase of the slab if there is enough time for diffusion. However, there is no time for the solute element such as copper (Cu)

in a concentration layer to sufficiently diffuse toward the liquid phase, taking substantial residence time into account.

Then, the molten aluminum in the meniscus area having the extremely thin oxide film and the extremely thin α-Al shell formed on the surface comes into contact with the belt and is chilled. Thus, the extremely thin α-Al shell and the segregation layer in the liquid phase formed therein are also chilled, and the oxide film, the α-Al shell, the segregation layer in the solid phase, and a chilled solidified structure are formed in this order on the surface of the slab. These are generally called a shell. In the segregation layer, the copper concentration peak is present at a depth of about 200 nm from the material surface of the thin slab. Then, the thickness of the α-Al shell is relatively uniform in a slab surface layer portion although it may depend on a belt speed or the like. It is considered that a phenomenon as described above, of course, occurs in the continuous thin slab casting by the twin-roll casting machine.

The concentration peak of the segregation layer thus formed is estimated to be present at a depth of about 200 nm from the material surface of the thin slab. Then, in the manufacturing method according to the present embodiment, the thin slab is continuously cast, and the thin slab is directly wound around the roll without hot rolling, and is then subjected to cold rolling.

Here, the above-described cold rolling is such that the final cold reduction of the thin slab is 70 to 95%. After the cold rolling, the thin slab is subjected to final annealing. Thus, a facing process, a homogenization process, and a hot rolling process required for the conventional direct chill casting slab (or a DC casting slab) can be omitted, and processing costs can be reduced. As further described later, dislocations are accumulated by performing deformation process while ensuring a predetermined amount of solid solution of a transition metallic element, and fine recrystallized grains of 15 μm or less of the aluminum alloy can be obtained in the final annealing process.

When the final cold reduction is less than 70%, the amount of work strain accumulated during the cold rolling is too small, and the fine recrystallized grains of 15 μm or less cannot be obtained by the final annealing process. When the final cold reduction exceeds 95%, the amount of work strain accumulated during the cold rolling is too large, work hardening is intensive, cracking occurs in edges, and the rolling becomes difficult to perform. Therefore, it is preferable that the final cold reduction be in the range of 70 to 95%. More preferably, the final cold reduction is in the range of 70 to 90%. Still more preferably, the final cold reduction is in the range of 70 to 85%. Incidentally, as employed herein, the final cold reduction refers to the degree of rolling at the time of the final cold rolling. For example, in a case where an aluminum sheet of 1.0 mm thick is cold rolled to 0.6 mm, the final cold reduction is represented as 40%.

Then, in the final annealing, an element such as copper is diffused and concentrated to a boundary between the oxide film and the surface of the alloy sheet from the segregation layer having the copper concentration peak at a depth of, for example, about 50 nm from the surface of the aluminum alloy sheet. However, the copper concentration peak of the segregation layer does not disappear. Then, as mentioned above, the aluminum alloy is affected greatly by the influence of the amount of copper in particular, and tends to improve in zinc phosphate treatability with a higher copper content. Therefore, the aluminum alloy sheet according to the present embodiment contains a predetermined amount of copper, and thus, in the zinc phosphate treatment, the cathodic reaction (2) is accelerated on the surface even at early stages in the reaction. Moreover, the segregation layer having a copper concentration peak of 0.15% by mass or more is present at a predetermined depth from the surface of the aluminum alloy sheet according to the present embodiment. Thus, even if Al on the surface is dissolved as $Al^{3+}$ ions into the solution and the surface of the alloy sheet is corroded, the effect of accelerating the cathodic reaction (2) is continued by the copper segregation layer.

In accordance with the above, the copper content of the overall aluminum alloy sheet (or aluminum alloy substrate) according to the present embodiment is required to be not less than 0.03% by mass but less than 0.10% by mass. However, in the final aluminum alloy sheet, the peak concentration of the copper concentration distribution in the thickness direction in the region at a depth from 15 nm to 200 nm from the surface of the aluminum alloy sheet is 0.15% by mass or more.

Incidentally, although a lower limit of the peak concentration of the copper concentration distribution in the thickness direction in the region at a depth from 15 nm to 200 nm from the surface of the aluminum alloy sheet is 0.15% by mass, an upper limit of the peak concentration is not particularly limited. However, the upper limit of the peak concentration may be set to 1.0% by mass, for example. Also, although an upper limit of the average grain size of the recrystallized structure in the aluminum alloy sheet is 15 μm, a lower limit of the average grain size is not particularly limited. However, the lower limit of the average grain size may be set to 5 μm, for example.

In the manufacturing method according to the present embodiment, it is preferable that the thickness of the thin slab cast be 2 mm to 15 mm. When the thickness of the thin slab is less than 2 mm, it is difficult to uniformly pour the molten aluminum into the cavity and cast a good thin slab. When the thickness of the thin slab exceeds 15 mm, it is difficult to wind the thin slab around the coil. When the thickness falls within this range, a solidification cooling rate of the order of 20 to 500° C./sec can be easily ensured in a range of ¼ of the thickness of the slab, and thus, a uniform cast structure can be obtained. As a result, as described later, a predetermined amount of solid solution of a transition metallic element such as Fe or Mn in a matrix can be ensured.

Also, when the thickness of the thin slab falls within this range, the size of an intermetallic compound formed during casting solidification is reduced to less than 5 μm, and the number of intermetallic compounds per unit area of the alloy sheet can be increased. The intermetallic compound having an average grain size of the order of 1 to 5 μm forms a core of a recrystallized grain during the final annealing, and also exhibits a pinning effect of inhibiting movement of a crystal grain boundary.

By these effects, consequently, the average grain size of the recrystallized grains of the aluminum alloy after the final annealing is easily controlled to 15 μm or less, and the aluminum alloy sheet excellent in formability can be obtained. More preferably, the thickness of the thin slab is in the range of 3 mm to 12 mm. Still more preferably, the thickness of the thin slab is in the range of 5 mm to 12 mm.

Preferably, the coil of the thin slab cold rolled to a predetermined thickness is subjected to final annealing for 1 to 8 hours at a holding temperature of 300 to 400° C. by using a batch annealing furnace. The batch annealing refers to annealing which is performed with the coil of the thin slab in a stationary position. When the holding temperature in the batch annealing furnace is equal to or higher than 300° C., recrystallization proceeds and a uniform recrystallized structure of the aluminum alloy can be easily obtained. Also, when the holding temperature is equal to or lower than 400° C., coarsening of recrystallized grains by the joining together of recrystallized grains is not prone to occur, and a recrystallized structure of the aluminum alloy having an average grain size of 15 μm or less can be easily obtained. Further, excessive softening of the thin slab is prevented, and a predetermined strength can be easily obtained.

Therefore, it is preferable that the temperature of the final annealing be in the range of 300 to 400° C. Also, when the holding time for the above-described annealing temperature is equal to or more than 1 hour, the overall coil can be processed at a more uniform temperature. Further, when the holding time is equal to or less than 8 hours, a recrystallized structure having an average grain size of 15 μm or less can be obtained, and productivity can be further improved. Therefore, it is preferable that the holding time be in the range of 1 to 8 hours.

Also, it is preferable that the coil of the thin slab cold rolled to a predetermined thickness be subjected to final annealing for 10 to 60 seconds at a holding temperature of 400 to 500° C. by using a continuous annealing furnace (a CAL annealing furnace). The continuous annealing refers to annealing which is performed while the coil of the thin slab is continuously moved in the furnace. In the continuous annealing, when the holding temperature is equal to or higher than 400° C., recrystallization proceeds and a uniform recrystallized structure can be easily obtained. Also, when the holding temperature is equal to or lower than 500° C., coarsening of recrystallized grains by the joining together of recrystallized grains is not prone to occur, and a recrystallized structure having an average grain size of 15 μm or less can be easily obtained. Further, excessive softening of the thin slab is prevented, and a predetermined strength can be easily obtained.

Therefore, it is preferable that the temperature of the final annealing in the continuous annealing be in the range of 400 to 500° C. Also, when the holding time for the above-described annealing temperature is equal to or more than 10 seconds, the overall coil can be processed at a more uniform temperature. Further, when the holding time is equal to or less than 60 seconds, a recrystallized structure having an average grain size of 15 μm or less can be obtained, and productivity can be further improved. Therefore, it is preferable that the holding time be in the range of 10 to 60 seconds.

In the present embodiment, the tensile strength of the aluminum alloy sheet (or the aluminum alloy substrate) obtained in the above-mentioned manner is not necessarily an essential requirement. However, high strength properties may be sought, depending on applications for use as a structural member of an automobile. Therefore, the tensile strength of the aluminum alloy sheet (or the aluminum alloy substrate) is preferably equal to or more than 240 MPa, or more preferably equal to or more than 250 MPa.

Description will be given below with regard to a reason for limiting the range of the composition of an alloy component in the aluminum alloy sheet (or the aluminum alloy substrate) of the present embodiment.

[Regarding 3.0 to 4.0% by Mass of Magnesium (Mg)]

In the aluminum alloy sheet of the present embodiment, magnesium (Mg) is an essential element. Then, magnesium acts as an element to form a solid solution in a matrix of aluminum and strengthen the solid solution, and thus, magnesium is added in order to impart strength and formability.

When a magnesium concentration is less than 3.0% by mass, its effect is small and the aluminum alloy sheet having a predetermined tensile strength cannot be obtained. When the magnesium concentration exceeds 4.0% by mass, an SS mark appears, and there may arise the problem of being sensitive to stress corrosion cracking or doing the like. Therefore, it is preferable that the magnesium concentration be in the range of 3.0 to 4.0% by mass. More preferably, the magnesium concentration is in the range of 3.2 to 4.0% by mass. Still more preferably, the magnesium concentration is in the range of 3.4 to 3.8% by mass.

[Regarding 0.2 to 0.4% by Mass of Manganese (Mn)]

In the aluminum alloy sheet of the present embodiment, manganese (Mn) is an essential element. Manganese (Mn) coexists with iron (Fe) and silicon (Si) thereby to uniformly and finely precipitate an Al—Fe based compound, an Al—(Fe.Mn)—Si based compound, or the like in the thin slab. As a result, as mentioned above, the average recrystallized grain size of the aluminum alloy is as fine as 15 μm or less. Also, manganese is an element which is easier to form a solid solution in a supersaturation in a matrix during casting, as compared to iron, and bake softening resistance can be imparted to the final aluminum alloy sheet.

When a manganese concentration is less than 0.2% by mass, the bake softening resistance is low and a predetermined tensile strength and a predetermined average recrystallized grain size cannot be obtained. When the manganese concentration exceeds 0.4% by mass, this is undesirable because the strength becomes too high and formability may deteriorate. Therefore, it is preferable that the manganese concentration be in the range of 0.2 to 0.4% by mass. More preferably, the manganese concentration is in the range of 0.25 to 0.4% by mass. Still more preferably, the manganese concentration is in the range of 0.3 to 0.4% by mass.

[Regarding 0.1 to 0.5% by Mass of Iron (Fe)]

In the aluminum alloy sheet of the present embodiment, iron (Fe) is an essential element. Iron (Fe) coexists with manganese (Mn) and silicon (Si) thereby to uniformly and finely precipitate an Al—Fe based compound, an Al—(Fe.Mn)—Si based compound, or the like in the thin slab. As a result, as mentioned above, the average recrystallized grain size of the aluminum alloy is as fine as 15 μm or less. Also, iron is an element which is easier to precipitate during casting, as compared to manganese, and thus, the contribution of iron to the bake softening resistance of the final aluminum alloy sheet is lower than that of manganese.

When an iron concentration is less than 0.1% by mass, the bake softening resistance is low and a predetermined tensile strength and a predetermined average recrystallized grain size cannot be obtained. When the iron concentration exceeds 0.5% by mass, this is undesirable because a coarse needle-like intermetallic compound develops and formability may deteriorate. Therefore, it is preferable that the iron concentration be in the range of 0.1 to 0.5% by mass. More preferably, the iron concentration is in the range of 0.1 to 0.4% by mass. Still more preferably, the iron concentration is in the range of 0.1 to 0.3% by mass.

[Regarding not Less than 0.03% but Less than 0.10% by Mass of Copper (Cu)]

In the aluminum alloy sheet of the present embodiment, copper (Cu) is an essential element. Also, the total copper concentration in the aluminum alloy sheet (or the aluminum alloy substrate) is set to not less than 0.03% but less than 0.10% by mass. Further, the peak concentration of the copper concentration distribution in the thickness direction in the region at a depth from 15 nm to 200 nm from the surface is set to 0.15% by mass or more. Thus, during zinc phosphate treatment, the effect of accelerating the cathodic reaction (2) is continued on the surface of the aluminum alloy sheet, and zinc phosphate is uniformly deposited.

When the copper concentration is less than 0.03% by mass, the peak concentration of copper in the region at a depth from 15 nm to 200 nm from the surface of the alloy sheet is less than 0.15% by mass, and zinc phosphate may be non-uniformly deposited. When the copper concentration is equal to or more than 0.10% by mass, there may be the fear of a reduction in corrosion resistance such as filiform corrosion resistance or coating film blistering resistance after coating. Therefore, it is preferable that the copper concentration be in the range of not less than 0.03% but less than 0.10% by mass. More preferably, the copper concentration is in the range of not less than 0.03% but less than 0.07% by mass. Still more preferably, the copper concentration is in the range of not less than 0.03% but less than 0.05% by mass.

[Regarding Less than 0.20% by Mass of Silicon (Si)]

Preferably, the concentration of silicon (Si) as the unavoidable impurities is limited to less than 0.20% by mass, that is, not less than 0% by mass but less than 0.20% by mass. When the silicon concentration is equal to or more than 0.20% by mass, this is undesirable because a coarse Al—(Fe.Mn)—Si based compound is precipitated during thin slab casting and formability deteriorates.

More preferably, the silicon concentration is less than 0.18% by mass. Still more preferably, the silicon concentration is less than 0.15% by mass. In the present embodiment, when the silicon concentration is less than 0.15% by mass, the formability does not deteriorate.

[Regarding Other Unavoidable Impurities]

The unavoidable impurities are unavoidably mixed from raw metal, a return scrap, or the like. For example, the allowable concentration of the unavoidable impurities is such that zinc (Zn) is less than 0.4% by mass, nickel (Ni) is less than 0.2% by mass, and gallium (Ga) and vanadium (V) are less than 0.05% by mass. Also, lead (Pb), bismuth (Bi), tin (Sn), sodium (Na), calcium (Ca), and strontium (Sr) are each less than 0.02% by mass. Other elements are less than 0.05% by mass, and the effects of the present invention cannot be diminished even if other elements are contained in this range.

[Regarding Mn/Fe Ratio]

The mass ratio of manganese to iron (or the Mn/Fe ratio) is not an essential constituent factor of the aluminum alloy sheet of the present embodiment. However, an Al—Fe—Si based intermetallic compound contains manganese, and further, the higher manganese concentration makes it easier to form an Al—Fe.Mn—Si based intermetallic compound. Also, the Al—Fe—Si based intermetallic compound is in needle form, whereas the Al—Fe.Mn—Si based intermetallic compound has a spherical shape. Thus, mechanical properties of the aluminum alloy sheet, such as fatigue strength and elongation, can be improved.

When the Mn/Fe ratio is equal to or more than 1.0, the effects of the above-described mechanical properties can be obtained. When the Mn/Fe ratio is equal to or less than 5.0, high formability can be achieved while sufficient strength is ensured. Therefore, it is preferable that the Mn/Fe ratio be in the range of 1.0 to 5.0. More preferably, the Mn/Fe ratio is in the range of 1.0 to 4.0. Still more preferably, the Mn/Fe ratio is in the range of 1.0 to 3.0.

[Regarding Titanium (Ti)]

The aluminum alloy sheet of the present embodiment may contain titanium (Ti) besides the above-described elements. Titanium may be mixed from a return scrap, and is also unavoidable impurities. Also, titanium is added to molten aluminum as a grain refiner for crystal grains in an ingot, and further, typically as an Al—Ti based or Al—Ti—B based hardener.

When a titanium concentration is equal to or more than 0.005% by mass, the effects of the grain refiner and the hardener can be easily obtained. Also, when the titanium concentration is equal to or less than 0.1% by mass, a reduction in formability due to the precipitation of an intermetallic compound such as coarse $Al_3Ti$ in the ingot can be effectively prevented. Therefore, it is preferable that the titanium concentration be in the range of 0.005 to 0.1% by mass. More preferably, the titanium concentration is in the range of 0.005 to 0.08% by mass. Still more preferably, the titanium concentration is in the range of 0.005 to 0.05% by mass.

[Regarding Boron (B)]

The aluminum alloy sheet of the present embodiment may contain boron (B) besides the above-described elements. Boron (B) may be mixed from a return scrap, and is also unavoidable impurities. Also, boron is added to molten aluminum as a grain refiner for crystal grains in an ingot, and further, typically as an Al—Ti based or Al—Ti—B based hardener.

When a boron concentration is equal to or more than 0.0005% by mass, the effects of the grain refiner and the hardener can be easily obtained. Also, when the boron concentration is equal to or less than 0.01% by mass, sedimentation and aggregation of an intermetallic compound such as $TiB_2$ on a furnace bottom or the like can be prevented. Incidentally, when the intermetallic compound such as $TiB_2$ is mixed into the ingot, formability may deteriorate. Therefore, it is preferable that the boron concentration be in the range of 0.0005 to 0.01% by mass. More preferably, the boron concentration is in the range of 0.0005 to 0.005% by mass. Still more preferably, the boron concentration is in the range of 0.001 to 0.005% by mass.

The aluminum alloy sheet excellent in chemical conversion treatability of the present embodiment is suitable for a vehicle body panel and a structural member or the like of an automobile. Examples include outer panels and inner panels such as a hood 10, a door 11, a fender 12, a roof 13, and a trunk 14, and reinforced materials.

EXAMPLES

The advantageous effects of the present invention will be described by using Examples and Comparative Examples given below. However, it is to be understood that the technical scope of the present invention is not limited to only the following Examples.

First, molten alloys having compositions (Nos. 1 to 4) illustrated in Table 1 were prepared. Then, the molten alloys were continuously cast into thin slabs of 10 mm thick by a twin-belt casting machine and were directly wound up in coils. The thin slabs wound up in the coils were subjected to cold rolling to a thickness of 2.3 mm, and final annealing was applied to the thin slabs to hold the thin slabs at a temperature of 330° C. for 4 hours by a batch furnace. Incidentally, in this case, a final cold reduction was 77%. Then, the final sheets subjected to the final annealing were cleaned with an aqueous nitric acid solution to yield test sample materials. Incidentally, since these test sample materials are prepared by continuous casting, the test sample materials are indicated by "CC" in the column "Manufacturing Method" in Table 1.

Also, molten alloys having compositions (Nos. 5 and 6) illustrated in Table 1 were prepared. Then, the molten alloys were cast into slabs each having a width of 600 mm, a thickness of 400 mm and a length of 4000 mm by a DC casting machine. Then, each surface of each of the slabs was faced to about 20 to 30 mm by using a milling cutter. After that, the faced slabs were subjected to a homogenization process at 440° C. for 8 hours, and thereafter, the slabs were subjected to hot rolling and hot-rolled sheets of 7 mm were wound up in coils. After that, the thin slabs wound up in the coils were subjected to cold rolling to a thickness of 2.3 mm, and final annealing was applied to the thin slabs to hold the thin slabs at a temperature of 330° C. for 4 hours by a batch furnace. Then, the final sheets subjected to the final annealing were cleaned with an aqueous nitric acid solution to yield test sample materials. By this acid cleaning, the degreasing of the surface or the removal of some oxides such as MgO is performed. Incidentally, since these test sample materials are prepared by direct chill casting, the test sample materials are indicated by "DC" in the column "Manufacturing Method" in Table 1.

The following evaluations were performed on the test sample materials (Nos. 1 to 6): metallic structure evaluation (or average grain size measurement), tensile property evaluation, press formability evaluation, glow discharge-optical emission spectroscopy analysis (GD-OES analysis, copper concentration profile examination in a sheet thickness direction), and chemical conversion treatability evaluation.

TABLE 1

Composition Analysis Values of Test Sample Materials (% by mass)

| | Alloy | Mg | Mn | Fe | Si | Cu | Ti | Al | Manufacturing Method |
|---|---|---|---|---|---|---|---|---|---|
| Examples | No. 1 | 3.34 | 0.29 | 0.19 | 0.08 | 0.03 | 0.02 | Remainder | CC |
| | No. 2 | 3.36 | 0.29 | 0.18 | 0.08 | 0.05 | 0.02 | Remainder | CC |
| | No. 3 | 3.40 | 0.29 | 0.20 | 0.08 | 0.07 | 0.02 | Remainder | CC |
| Comparative | No. 4 | 3.46 | 0.31 | 0.19 | 0.08 | 0.01 | 0.02 | Remainder | CC |
| Examples | No. 5 | 4.60 | 0.31 | 0.19 | 0.08 | 0.05 | 0.02 | Remainder | DC |
| | No. 6 | 3.30 | 0.29 | 0.20 | 0.08 | 0.05 | 0.02 | Remainder | DC |

[Average Grain Size Measurement]

Each of the test sample materials was embedded in a resin so that a cross section of each test sample material could be observed, and further, the test sample materials were subjected to polishing and mirror polishing. The polished surfaces were subjected to an anodic oxidation process by an aqueous fluoroboric acid solution, and were photographed in three fields of view at 200× magnification by a polarizing microscope. Then, an intersecting line method was adopted to measure an average grain size of an aluminum alloy in the cross section of each test sample material. Incidentally, the intersecting line method refers to a method which involves drawing a straight line in any given direction on a photographed image, and dividing the length of the straight line by (n−1), where n denotes the number of grain boundaries intersecting the drawn straight line, thereby calculating the average grain size. The average grain sizes (μm) of the sheet materials are given in Table 2.

[Tensile Property Evaluation]

First, tensile test specimens of JIS-5 type were sampled from the test sample materials, along a direction parallel to a rolling direction, a direction perpendicular to the rolling direction, a direction at an angle of 45° to the rolling direction. Then, 0.2% yield strength and tensile strength were measured by performing tensile test at room temperature (25° C.) by using an autograph with a maximum load of 50 kN. In the tensile test, a strain rate was set to $6.7\times10^{-4}$ $s^{-1}$ before the 0.2% yield strength, and the strain rate was set to $3.3\times10^{-3}$ $s^{-1}$ after the 0.2% yield strength. Incidentally, elongation was measured with the fractured test specimens abutting against each other. The values of average tensile strength (MPa), 0.2% yield strength (MPa), and elongation (%) are given in Table 2.

[Press Formability Evaluation]

The test sample materials were pressed by using a mold for forming an automotive component, and the presence or absence of a stretcher-strain mark (SS mark) was checked by evaluating product appearance after forming by visual inspection. The SS mark refers to a surface pattern which appears on a sheet surface when an Al—Mg alloy is tensile tested or stretch formed, and the SS mark is divided into a random mark and a parallel band. The random mark refers to an irregular band-shaped pattern also called a flame shape, which appears in a part having a relatively small amount of strain. Also, the parallel band refers to a band-shaped pattern which appears at a particular angle to a tensile direction in a part having a relatively large amount of strain. It is known that the random mark is caused by yield point elongation, and the parallel band is caused by serration on a stress-strain curve. Higher magnesium concentration is more likely to cause the SS mark. The presence or absence of the SS mark in the test sample materials Nos. 1 to 6 is given in Table 2.

[Copper Concentration Profile Examination in Depth Direction of Sheet Thickness by GD-OES Analysis]

GD-OES (glow discharge-optical emission spectroscopy analysis) is performed in the following manner. First, an inert gas such as argon is introduced into a test specimen chamber evacuated to about 500 to 950 Pa. Then, the test specimens are made cathodic, and glow discharge is produced by the application of high power of about 30 to 70 W. At this time, a cathodic substance sputtered by collision of positive ions is ionized by inelastic collision of argon ions and secondary electrons. Then, a composition distribution in a depth direction from the surface of each test specimen is measured by performing spectrochemical analysis on light produced by excitation by the inelastic collision.

First, GD-OES analysis was performed on copper (Cu) in standard test specimens, by using a high-frequency glow discharge-optical emission spectroscopy surface analyzer (GD-Profiler 2, available from HORIBA, Ltd.), under measurement conditions as given below: an argon pressure of 600 Pa, 35 watts of RF power, and a wavelength of 325 nm. Thereby, an emission intensity-copper content working curve was prepared. Then, the intensity of light with a wavelength of 325 nm was measured in the depth direction (with a lapse of time) from the material surface of each test sample material, and was converted to a copper concentration distribution in a region to a depth of 500 nm from the material surface.

Figure 2:
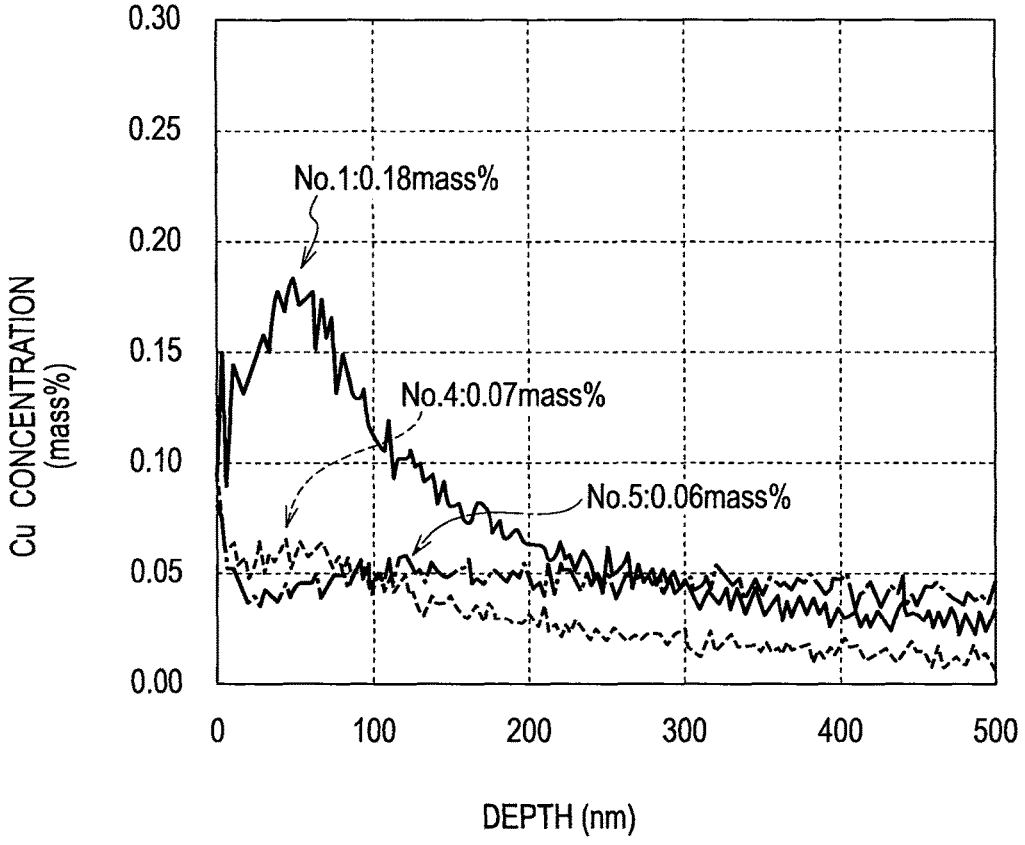
FIG. 2 is a graph illustrating a copper concentration in a region to a depth of about 500 nm from the surface of each of test sample materials Nos. 1, 4 and 5.

FIG. 2 illustrates the copper concentration in a region to a depth of about 500 nm from the material surfaces of the test sample materials Nos. 1, 4 and 5. From this graph, it can be seen that the copper concentration distribution has a clear peak in a region at a depth of 15 to 200 nm from the material surface of the test sample material No. 1. Also, in the graph of the copper concentration distribution measured for each of the test sample materials Nos. 4 and 5, the copper concentration distribution did not have a clear peak in the region at a depth of 15 to 200 nm from each material surface, but a maximum value of the copper concentration was set as a copper (Cu) peak concentration. In this manner, the copper (Cu) peak concentration in the region at a depth of 15 to 200 nm from the material surface was read from the graph of the copper concentration distribution measured for each of the test sample materials Nos. 1 to 6. The copper (Cu) peak concentrations of the test sample materials are given in Table 2.

[Chemical Conversion Treatability Evaluation]

Test specimens of 70 mm×150 mm were cut out from the test sample materials, were immersed in an alkaline degreasing solution for 120 seconds and were rinsed by spray, and thereafter, the test specimens were subjected to surface conditioning by a Zn-based surface conditioning agent. Then, the surface of each test specimen was subjected to zinc phosphate chemical conversion treatment. After that, film uniformity was checked by observing the appearance of crystals by using a scanning electron microscope (SEM). Evaluations of the test sample materials are as follows: "○" represents a test sample material in which non-uniformity in the appearance of crystals was not observed, and "x" represents a test sample material in which non-uniformity in the appearance of crystals was observed. The evaluated results of chemical conversion treatability of the test sample materials are given in Table 2.

TABLE 2

Evaluated Results of Various Properties of Test Sample Materials

| | Alloy | Average grain size (μm) | 0.2% Yield Strength (MPa) | Tensile Strength (MPa) | Elongation (%) | Cu Peak Concentration (mass %) | SS Mark | Chemical Conversion Treatability |
|---|---|---|---|---|---|---|---|---|
| Examples | No. 1 | 12 | 128 | 257 | 29 | 0.18 | Absent | ○ |
| | No. 2 | 11 | 131 | 263 | 28 | 0.27 | Absent | ○ |
| | No. 3 | 12 | 129 | 261 | 27 | 0.41 | Absent | ○ |
| Comparative Examples | No. 4 | 12 | 129 | 259 | 27 | 0.07 | Absent | x |
| | No. 5 | 23 | 129 | 281 | 30 | 0.06 | Present | ○ |
| | No. 6 | 21 | 120 | 235 | 25 | 0.06 | Absent | ○ |

[Results of Various Evaluations]

The test sample materials Nos. 1 to 3 satisfied predetermined conditions for all evaluation items given below: the average grain size, the peak concentration of copper, the SS mark, and the chemical conversion treatability, and had a tensile strength of 240 MPa or more.

On the other hand, the test sample materials Nos. 4 to 6 do not satisfy the predetermined conditions for some evaluation items. The test sample material No. 4, although it was the CC material, had a low copper concentration of 0.01% by mass and was inferior in the chemical conversion treatability.

The test sample material No. 5 had a copper concentration of 0.05% by mass but had a high magnesium concentration of 4.60% by mass, and had the tensile strength having a high value although it was the DC material. However, the test sample material No. 5 had an average grain size of 23 μm larger than a predetermined value, and thus, the SS mark was observed in the appearance after forming. Also, in the case of the DC material, the DC material was subjected to facing on both surfaces before homogenization treatment, and thus, a slab surface layer portion was removed, and an apparent peak was absent in the copper concentration distribution in the thickness direction in the region at a depth of 15 nm to 200 nm from the material surface of the aluminum alloy sheet. (See No. 5 in FIG. 2.)

The test sample material No. 6 had a copper concentration of 0.05% by mass; however, because of the DC material, the test sample material No. 6 had an average grain size of 21 μm larger than the predetermined value and had a reduced tensile strength of 235 MPa.

Figure 3:
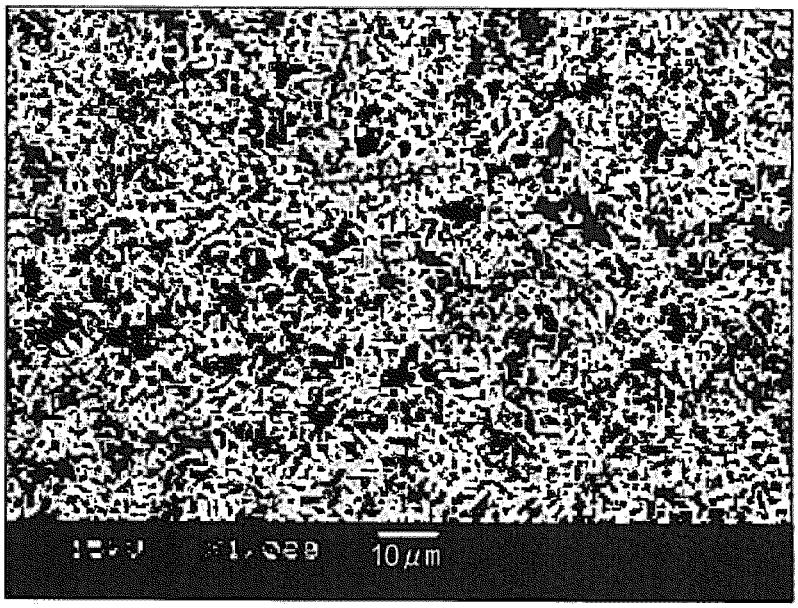
FIG. 3 is photographs depicting the appearance of crystals in the test sample materials Nos. 1 and 4 after chemical conversion treatment.
Figure 3:
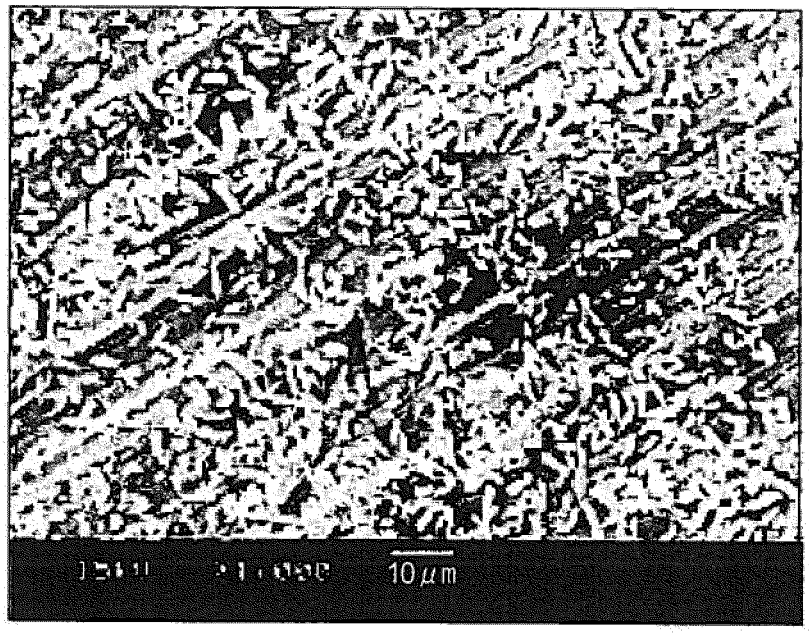

FIG. 3 is photographs depicting the appearance of crystals in the test sample materials Nos. 1 and 4 after chemical conversion treatment. As depicted in FIG. 3(*a*), it can be seen that, in the test sample material No. 1, uniformity in the appearance is improved by reducing non-uniformity in the appearance by the addition of copper and a zinc phosphate film is uniformly formed. On the other hand, as depicted in FIG. 3(*b*), it can be seen that, in the test sample material No. 4, due to an insufficient amount of copper added, a zinc phosphate film is segregated and the aluminum alloy sheet is exposed.

The entire contents of Japanese Patent Application No. 2011-162284 (filed on Jul. 25, 2011) are incorporated herein by reference.

While the contents of the present invention have been described above with reference to the present embodiment, it is to be understood that the present invention is not limited to these descriptions, and it would be obvious to one of ordinary skill in the art that various modifications and improvements could be made thereto.

INDUSTRIAL APPLICABILITY

According to the present invention, it is possible to provide an aluminum alloy sheet excellent in formability and chemical conversion treatability and a method for manufacturing the same.

REFERENCE SIGNS LIST

10 HOOD
11 DOOR
12 FENDER
13 ROOF
14 TRUNK

The invention claimed is:

1. An aluminum alloy sheet, comprising:

an aluminum alloy substrate having a composition containing, by mass percentage, 3.0 to 4.0% of magnesium, 0.3 to 0.4% of manganese, 0.1 to 0.5% of iron, not less than 0.03% but less than 0.05% of copper, less than 0.20% of silicon, 0.005 to 0.1% titanium, and 0.0005 to 0.01% boron, with a remainder being aluminum and unavoidable impurities, wherein a peak concentration of a copper concentration distribution in a thickness direction in a region at a depth of 15 nm to 200 nm from a surface of the aluminum alloy substrate is equal to or more than 0.15% by mass, and wherein the aluminum alloy substrate has a recrystallized structure with an average grain size of 15 μm or less.

2. The aluminum alloy sheet according to claim 1, wherein the aluminum alloy substrate has a tensile strength of 240 MPa or more.

* * * * *